US006520751B2

(12) United States Patent
Fujita et al.

(10) Patent No.: US 6,520,751 B2
(45) Date of Patent: Feb. 18, 2003

(54) VARIABLE DISPLACEMENT COMPRESSOR HAVING A NOISE REDUCING VALVE ASSEMBLY

(75) Inventors: Masaaki Fujita, Isesaki (JP); Masayoshi Tsukagoshi, Gunma (JP); Kazuhiko Takai, Gunma (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/822,334

(22) Filed: Apr. 2, 2001

(65) Prior Publication Data

US 2001/0026762 A1 Oct. 4, 2001

(30) Foreign Application Priority Data

Apr. 4, 2000 (JP) ..... 2000-106720

(51) Int. Cl.[7] ..... F04B 43/06; F04B 1/12; F04B 49/00; F04B 23/00; F16K 15/00

(52) U.S. Cl. ..... 417/295; 417/269; 417/440; 417/298; 137/513.3

(58) Field of Search ..... 417/269, 440, 417/298, 295; 137/513.3, 514.5

(56) References Cited

U.S. PATENT DOCUMENTS 4,407,639 A * 10/1983 Maruyama ..... 417/292
4,580,949 A * 4/1986 Maruyama et al. ..... 417/269
4,691,526 A * 9/1987 Kobayashi et al. ..... 62/217
4,780,060 A 10/1988 Terauchi
4,867,649 A * 9/1989 Kawashima et al. ..... 417/222 S
4,874,295 A 10/1989 Kobayashi et al.
4,878,817 A 11/1989 Kikuchi et al.
4,960,367 A 10/1990 Terauchi
5,173,032 A * 12/1992 Taguchi et al. ..... 417/222.2
5,782,615 A * 7/1998 Noah et al. ..... 417/310
5,823,000 A * 10/1998 Takai ..... 62/123
5,873,704 A * 2/1999 Ota et al. ..... 417/222.2
6,074,173 A 6/2000 Taguchi
6,099,276 A 8/2000 Taguchi
6,102,670 A 8/2000 Taguchi
6,179,572 B1 1/2001 Taguchi
6,196,808 B1 3/2001 Taguchi
6,257,848 B1 7/2001 Terauchi

* cited by examiner

*Primary Examiner*—Charles G. Freay
*Assistant Examiner*—Timothy P. Solak
(74) *Attorney, Agent, or Firm*—Baker Botts L.L.P.

(57) ABSTRACT

In a variable displacement compressor of a piston type, a valve body (34) is movably placed adjacent to a main channel (32) communicating a suction port (26) with a suction chamber (24). The valve body is for variably controlling an opening area of the main channel. A fluid damper (38) is coupled to the valve body to damp vibration of the valve body. In addition, a bypass channel (39) is formed outside of the air damper to communicate the suction port with the suction chamber.

7 Claims, 6 Drawing Sheets

EARLIER TECHNOLOGY

VARIABLE DISPLACEMENT COMPRESSOR HAVING A NOISE REDUCING VALVE ASSEMBLY

BACKGROUND OF THE INVENTION

This invention relates to a variable displacement compressor of a piston type.

Such a variable displacement compressor comprises a piston reciprocally driven in a cylinder bore. The piston has suction and compression strokes which are alternatively repeated to compress a gaseous fluid such as a refrigerant gas. During the suction stroke, the gaseous fluid is sucked into the cylinder bore through a suction port and a suction chamber of the compressor. During the compression stroke, the gaseous fluid id compressed in the cylinder bore into a compressed fluid. The compressed fluid is discharged from the cylinder bore to a discharge chamber of the compressor. In this type of a variable displacement compressor, it is assumed that the compressed fluid has pressure pulsation when the compressed fluid has a flow rate which is relatively low.

For example, a variable displacement compressor is revealed in U.S. Pat. No. 6,257,848, filed on Aug. 20, 1999, by Kiyoshi Terauchi, for assignment to the present assignee, based on Japanese Patent Application No. 153,853 of 1999 filed on Jun. 1, 1999. The variable displacement compressor is provided with an opening control valve disposed in a main channel between the suction port and the suction chamber for variably controlling an opening area of the main channel.

Referring to FIG. 1, description will be made as regards the opening control valve included in a variable displacement compressor in an earlier technology. The opening control valve has a valve body 4 for opening and closing a main channel 3 between a suction port 1 and a suction chamber 2, a cavity 5 for slidably receiving the valve body 4, a return spring 6 arranged within the cavity 5, a communication path 7 for establishing communication between the cavity 5 and the suction chamber 2, and a communication path 8 formed in the valve body 4. The suction port 1 has a downstream end provided with a valve seat 1*a* for receiving the valve body 4 to be brought into contact therewith.

The above-mentioned variable displacement compressor is operable at a variable flow rate. At a high flow rate, a pressure difference between the suction port 1 and the suction chamber 2 is great. Therefore, a pressure difference between the suction port 1 and the cavity 5 communicating with the suction chamber 2 through the communication path 7 is great also. Thus, a difference between a primary pressure and a secondary pressure on primary and secondary sides of the valve body 4 is great. As a consequence, the valve body 4 is separated from the valve seat 1*a* to be retreated within the cavity 5 with the spring 6 compressed to a large extent. In this event, the opening area of the main channel 3 is increased. A refrigerant gas introduced from the suction port 1 passes through the main channel 3 increased in opening area to flow into the suction chamber 2. Then, the refrigerant gas presses and opens a suction valve 9 to flow into a cylinder bore 10.

At a low flow rate, the pressure difference between the suction port 1 and the suction chamber 2 is small. Therefore, the pressure difference between the suction port 1 and the cavity 5 communicating with the suction chamber 2 through the communication path 7 is small also. Thus, the difference between the primary pressure and the secondary pressure on the primary and the secondary sides of the valve body 4 is small. As a consequence, the valve body 4 compresses the spring 6 to a less extent so that the valve body 4 approaches the valve seat 1*a*. In this event, the opening area of the main channel 3 is reduced. A part of the refrigerant gas introduced from the suction port 1 flows into the suction chamber 2 through the main channel 3 reduced in opening area. On the other hand, the other part of the refrigerant gas flows through the communication path 8 formed in the valve body 4, the cavity 5, and the communication path 7 into the suction chamber 2. The refrigerant gas flowing into the suction chamber 2 presses and opens the suction valve 9 to flow into the cylinder bore 10.

At a very low flow rate, the pressure difference between the suction port 1 and the suction chamber 2 is very small. Thus, the primary pressure and the secondary pressure on the primary and the secondary sides of the valve body 4 are substantially balanced with each other, i.e., substantially equal to each other. Under a weak urging force of the spring 6 restored into a substantially unloaded condition, the valve body 4 is very close to the valve seat 1*a* to substantially close the main channel 3. The refrigerant gas introduced from the suction port 1 passes through the communication path 8 formed in the valve body 4, the cavity 5, and the communication path 7 to flow into the suction chamber 2.

At the low flow rate, pressure pulsation of the refrigerant gas caused by self-induced vibration of the suction valve 9 is attenuated during passage through the main channel 3 reduced in opening area or through the communication path 7 and the communication path 8 of the valve body 4. This suppresses a vibration noise of an evaporator produced by the pressure pulsation propagating from the suction port 1 through an external cooling circuit to the evaporator.

The opening control valve disclosed in the above-mentioned publication is disadvantageous in the following respect. At the very low flow rate, the substantial balance between the primary pressure and the secondary pressure on the primary and the secondary sides of the valve body 4 is lost in a suction stroke as a result of pressure loss during passage of the refrigerant gas through the communication path 8 of the valve body 4. On the other hand, in a compression stroke, the refrigerant gas does not flow through the communication path 8 of the valve body 4 so that the substantial balance between the primary pressure and the secondary pressure on the primary and the secondary sides of the valve body 4 is recovered. Under the circumstances, every time when the suction stroke and the compression stroke are alternately repeated, the valve body 4 repeatedly performs very fine movement alternately towards the cavity 5 and towards the valve seat 1*a*. Such repetition of fine movement of the valve body 4 induces the pressure pulsation of the refrigerant gas, which in turn causes a noise to be produced.

SUMMARY OF THE INVENTION

It is therefore an object of this invention to provide a variable displacement compressor of a piston type, which is capable of reducing generation of a noise resulting from repetition of fine movement of a valve body of the opening control valve at a very low flow rate.

Other objects of the present invention will become clear as the description proceeds.

According to an aspect of the present invention, there is provided a variable displacement compressor of a piston type, which comprises a suction port, a suction chamber, a main channel communicating the suction port with the suction chamber, a valve body movably placed adjacent to the main channel for variably controlling an opening area of the main channel, a fluid damper coupled to the valve body for damping vibration of the valve body, and a bypass channel formed outside of the fluid damper to communicate the suction port with the suction chamber.

According to another aspect of the present invention, there is provided a variable displacement compressor of a piston type, which comprises a suction port, a suction chamber, a main channel communicating the suction port with the suction chamber, a valve body movably placed adjacent to the main channel for variably controlling an opening area of the main channel, a fluid damper coupled to the valve body for damping vibration of the valve body, a bypass channel formed outside of the fluid damper to communicate the suction port with the suction chamber, a compressor housing defining the suction port and the suction chamber, and a valve case fixed to the compressor housing and defining the main channel, the valve body being movably held by the valve case, the fluid damper being formed between the valve case and the valve body.

According to still another aspect of the present invention, there is provided a variable displacement compressor of a piston type, which comprises a suction port, a suction chamber, a main channel communicating the suction port with the suction chamber, a valve body movably placed adjacent to the main channel for variably controlling an opening area of the main channel, a fluid damper coupled to the valve body for damping vibration of the valve body, a bypass channel formed outside of the fluid damper to communicate the suction port with the suction chamber, a compressor housing defining the suction port and the suction chamber, and a valve case fixed to the compressor housing and defining the main channel, the valve body being movably held by the valve case. In the variable displacement compressor, the suction port is cylindrical and extends in a predetermined direction, the valve case being placed in the suction port and having a cylindrical wall extending in the predetermined direction and a bottom wall connected to a suction chamber side of the cylindrical wall, the main channel being formed to the cylindrical wall, the valve body being fitted inside the cylindrical wall to be movable in the predetermined direction, the return spring being interposed between the valve body and the bottom wall to urge the valve body towards an open end of the cylindrical wall, the valve case having a stopping portion for stopping the valve body against the return spring, the fluid damper being formed between the valve body and the bottom wall to serve in the predetermined direction.

DESCRIPTION OF THE PREFERRED EMBODIMENTS

Figure 1:
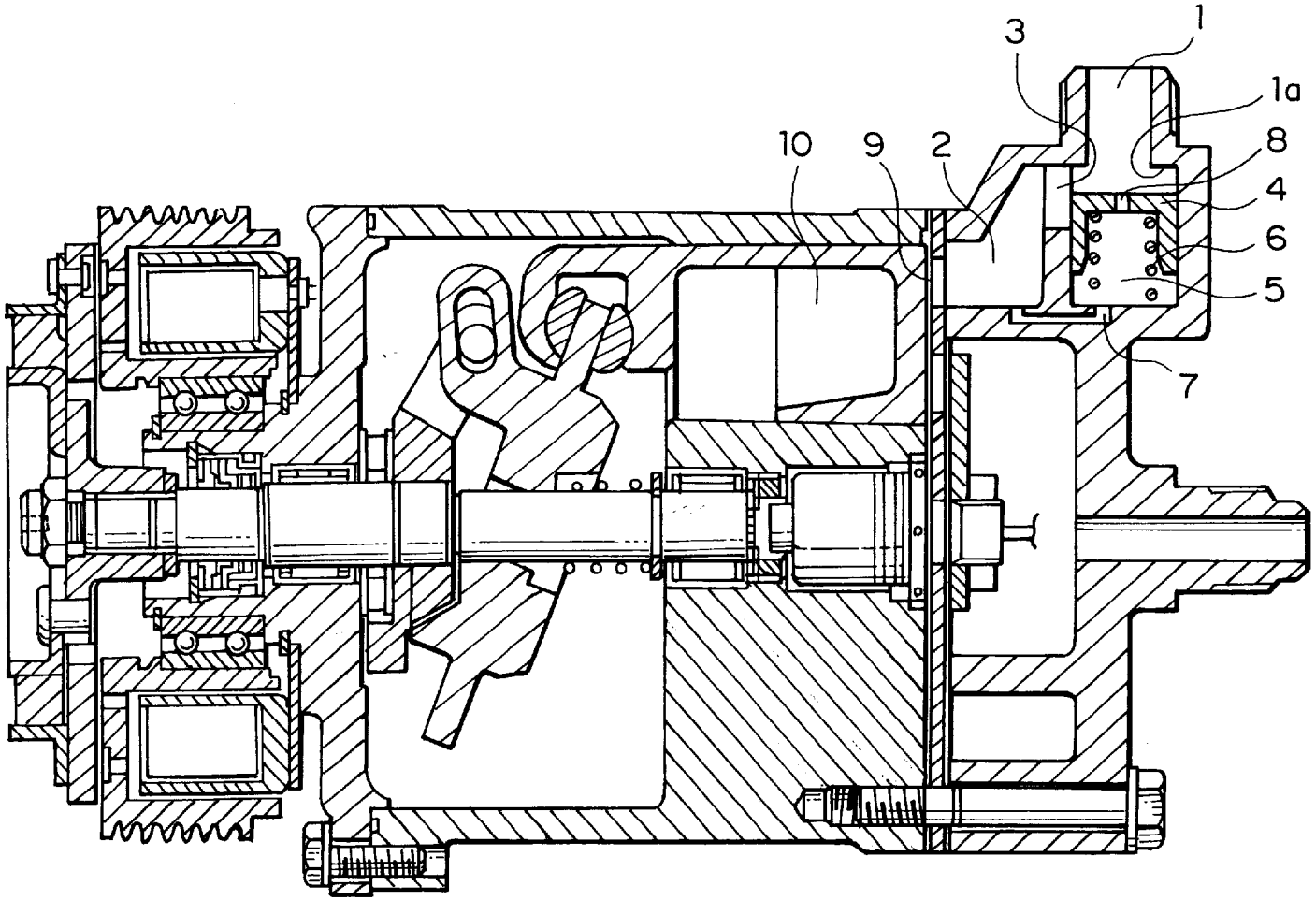
FIG. 1 is a sectional view of a variable displacement compressor in an earlier technology.
Figure 2:
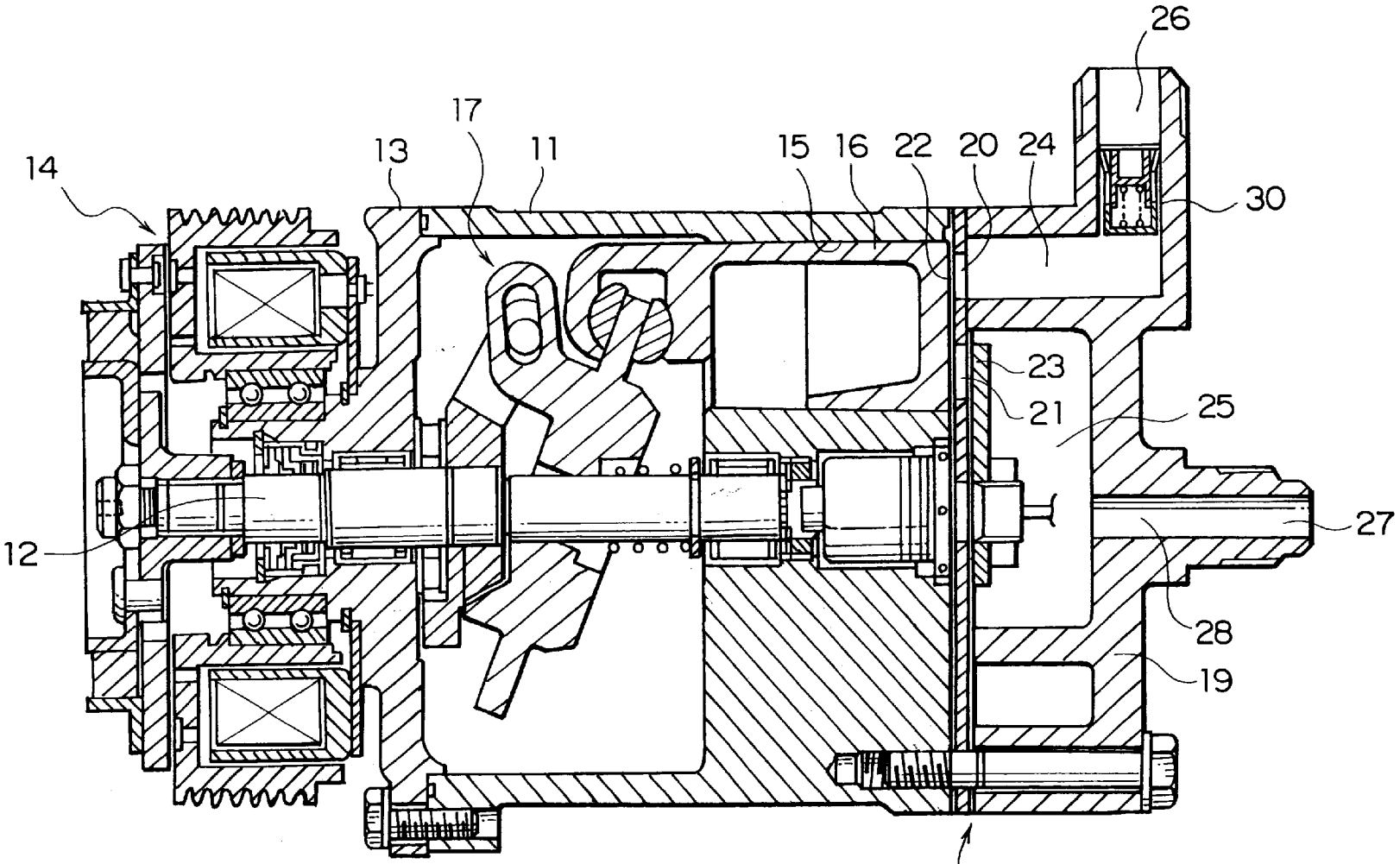
FIG. 2 is a sectional view of a variable displacement compressor according to an embodiment of this invention.

Referring to FIG. 2, description will be made as regards a variable displacement compressor according to an embodiment of the present invention.

The shown variable displacement compressor is for compressing a refrigerant gas and comprises a casing 11, a main shaft or spindle 12 accommodated in the casing 11, and a front housing 13 fixed to one end of the casing 11. The spindle 12 has one end extending outward through the front housing 13 to be connected through an electromagnetic clutch 14 to an external driving source (not shown).

Within the casing 11, a plurality of cylinder bores 15 are arranged with a space left from one another in a circumferential direction. Each cylinder bore 15 receives a piston 16 slidably inserted therein. The piston 16 is connected to the spindle 12 through a crank mechanism 17 and, following the rotation of the spindle 12, performs reciprocal movement within the cylinder bore 15. The piston 16 has a stroke variably controlled via the crank mechanism 17.

The casing 11 has the other end to which a cylinder head 19 is fixed through a valve mechanism 18. The valve mechanism 18 has a suction hole 20, a discharge hole 21, a suction valve 22, and a discharge valve 23 which are faced to each cylinder bore. A combination of the casing 11, the front housing 13, and the cylinder head 19 will be referred to as a compressor housing.

The cylinder head 19 is provided with a suction chamber 24 communicating with the suction hole 20 and a discharge chamber 25 communicating with the discharge hole 21. The suction chamber 24 communicates with a suction port 26 extending vertically in a predetermined direction or a vertical direction. The suction port 26 is connected to a low-pressure side of a refrigerating circuit known in the art. The discharge chamber 25 communicates with a discharge port 27. The discharge port 27 is connected to a high-pressure side of the refrigerating circuit. At a downstream end of the suction port 26, an opening control valve 30 is disposed.

Figure 3A:
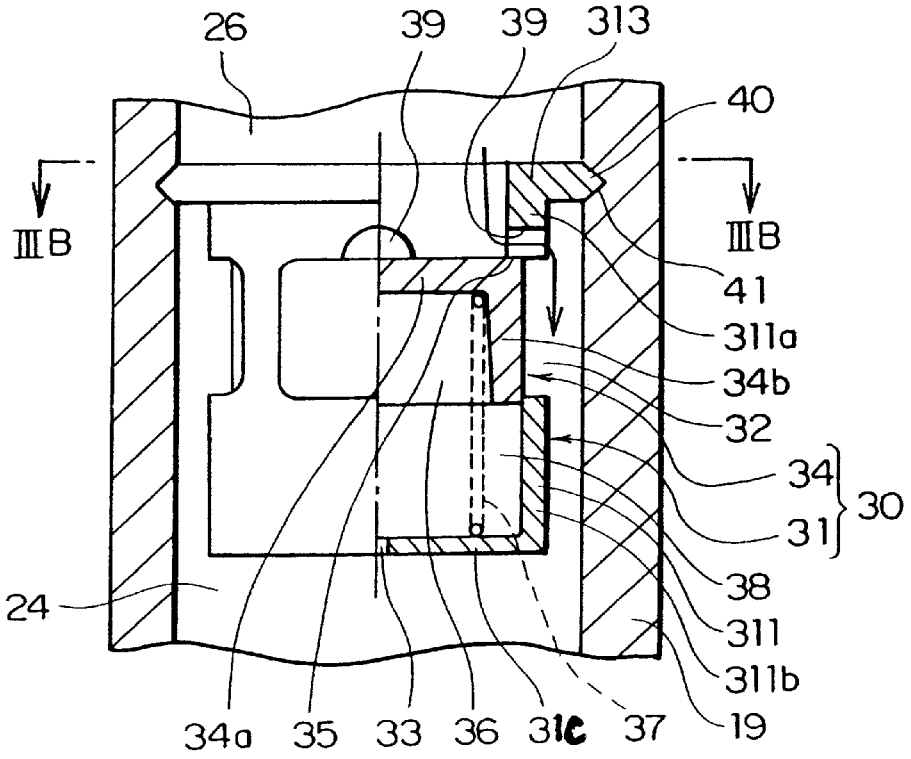
FIG. 3A is an enlarged sectional view of a main portion of the variable displacement compressor illustrated in FIG. 2.
Figure 3B:
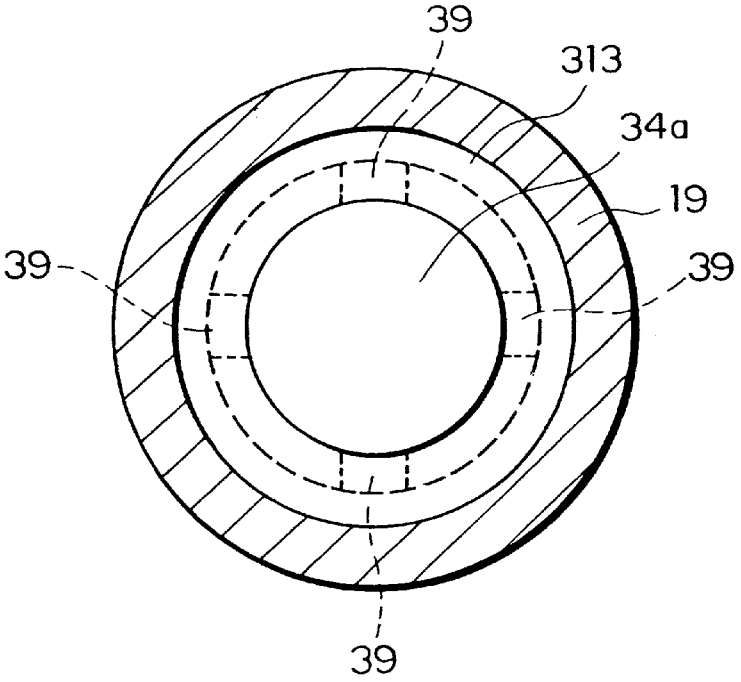
FIG. 3B is a sectional view taken along a line IIIB—IIIB in FIG. 3A.

Referring to FIGS. 3A and 3B, the opening control valve 30 comprises a cylindrical valve case 31 having a closed end at the bottom and an open end at the top. The valve case 31 has a cylindrical wall 311 extending in the vertical direction between the bottom and the top. The cylindrical wall 311 has a small-inner-diameter portion 311*a* near to the open end and a large-inner-diameter portion 311*b* near to the closed end. The valve case 31 further has a bottom wall 312 connected to the cylindrical wall 311 and forming the closed end. The large-inner-diameter portion 311*b* has a peripheral wall provided with an opening adjacent to the small-inner-diameter portion 311*a*. The opening defines a main channel 32 extending between the suction port 26 and the suction chamber 24. The bottom wall 312 of the valve case 31 is provided with a small hole 33 penetrating therethrough.

A valve body 34 in the form of a cylinder having one end as a closed end is fitted inside the large-inner-diameter portion 311*b* of the valve case 31 to be movable in the vertical direction. The valve body 34 has a bottom wall 34*a* faced to the open end of the valve case 31. The small-inner-diameter portion 311*a* has an end face confronting the bottom wall 34*a* and defining a valve seat 35. Irrespective of an axial position of the valve body 34 within the large-inner-diameter portion 311*b*, the valve body 34 is always brought into sliding contact with a lower part of the large-inner-diameter portion 31*b* which is nearer to the bottom wall 31*c* than the main channel 32. A combination of the valve body 34 and the above-mentioned lower part defines a chamber 36. Within the chamber 36, a return spring 37 is arranged to urge the valve body 34 towards the valve seat 35.

A combination of the valve body 34, the above-mentioned lower part of the large-inner-diameter portion 311*b*, the return spring 37, and the small hole 33 formed in the bottom wall 31 forms a fluid damper 38. The valve body 34 forms a piston of the fluid damper 38. The fluid damper 38 follows long-cycle variation in external force but does not follow short-cycle variation in external force. Therefore, if an external force varying in a long cycle is applied to the valve body 34, the valve body 34 is moved following the variation in external force. On the other hand, if an external force varying in a short cycle is applied to the valve body 34, the valve body 34 does not move following the variation in external force.

Outside of the fluid damper 38, more specifically, in a peripheral wall of the small-inner-diameter 311*a* of the valve case 31, a plurality of bypass holes 39 are formed adjacent to the main channel 32.

The valve case 31 has a flange 313 formed at the open end thereof. The flange 313 is provided with a protrusion 40 extending throughout an entire circumference thereof. On the other hand, the suction port 26 has a surrounding wall provided with a recess 41 extending throughout the entire circumference. The opening control valve 30 is disposed at the downstream end of the suction port 26 with the open end of the valve case 31 faced to an upstream side of the suction port 26. The opening control valve 30 is fixed to the cylinder head 19 by press-fitting the protrusion 40 formed on the flange 31*d* into the recess 41 formed in the surrounding wall of the suction port 26.

In the variable displacement compressor, the piston 16 performs reciprocal movement within the cylinder bore 15 following the rotation of the spindle 12. A refrigerant gas circulating from the low-pressure side of the external refrigerating circuit passes through the suction port 26, the main channel 32, the suction chamber 24, the suction hole 20, and the suction valve 22 to be sucked into the cylinder bore 15. Then, the refrigerant gas is compressed in the cylinder bore 15 and passes through the discharge hole 21, the discharge valve 23, the discharge chamber 25, and the discharge port 27 to be delivered to the high-pressure side of the external refrigerating circuit.

In the manner known in the art, the crank mechanism 17 variably controls the stroke of the piston 16. The variable displacement compressor has a discharge flow rate variably controlled in response to the stroke of the piston 16.

At a high flow rate, a pressure difference between the suction port 26 and the suction chamber 24 is great. Therefore, a pressure difference between the suction port 26 and the chamber 36 communicating with the suction chamber 24 through the small hole 33 is great also. Thus, a difference between a primary pressure and a secondary pressure on primary and secondary sides of the valve body 34 is great. As a consequence, the valve body 34 is separated from the valve seat 35 and moves towards the bottom wall 31*c* with the return spring 37 compressed to a large extent. In this event, an opening area of the main channel 32 is increased. As a result, the refrigerant gas of a high flow rate flows from the suction port 26 through the main channel 32 into the suction chamber 24.

At a low flow rate, the pressure difference between the suction port 26 and the suction chamber 24 is small. Therefore, the pressure difference between the suction port 26 and the chamber 36 communicating with the suction chamber 24 through the small hole 33 is small also. Thus, the difference between the primary pressure and the secondary pressure on the primary and the secondary sides of the valve body 34 is small. As a consequence, the valve body 34 compresses the return spring 37 to a less extent so that the valve body 34 approaches the valve seat 35. In this event, the opening area of the main channel 32 is reduced. At the low flow rate, pressure pulsation of the refrigerant gas caused by self-induced vibration of the suction valve 22 is attenuated during passage through the main channel 32 reduced in opening area. This suppresses a vibration noise of an evaporator resulting from the pressure pulsation propagating from the suction port 26 through the external refrigerating circuit to the evaporator.

At a very low flow rate, the pressure difference between the suction port 26 and the suction chamber 24 is very small. Thus, the primary pressure and the secondary pressure on the primary and the secondary sides of the valve body 34 are substantially balanced with each other, i.e., substantially equal to each other. Under a weak urging force of the return spring 37 restored into a substantially unloaded condition, the valve body 34 is brought into contact with the valve seat 35 so that the main channel 32 is closed. The refrigerant gas introduced from the suction port 26 passes through the bypass holes 39 and flows through the suction port 26 into the suction chamber 24 and then into the cylinder bore 15. Each of the bypass holes 39 is referred to as a bypass channel.

At the very low flow rate, the substantial balance between the primary pressure and the secondary pressure on the primary and the secondary sides of the valve body 34 is lost in a suction stroke as a result of pressure loss while the refrigerant gas introduced from the suction port 26 passes through the bypass holes 39. On the other hand, in a compression stroke, the refrigerant gas does not flow through the bypass holes 39 so that the substantial balance between the primary pressure and the secondary pressure on the primary and the secondary sides of the valve body 34 is recovered. Therefore, the valve body 34 is applied with the external force varying in a short cycle. However, since the valve body 34 forms the piston of the fluid damper 38, the valve body 34 does not follow the short-cycle variation in external force and does not repeatedly perform fine movement. Therefore, neither the pressure pulsation of the refrigerant gas nor the noise is induced.

In the foregoing, one embodiment of this invention has been described. However, this invention is not restricted to the above-mentioned embodiment.

Figure 4A:
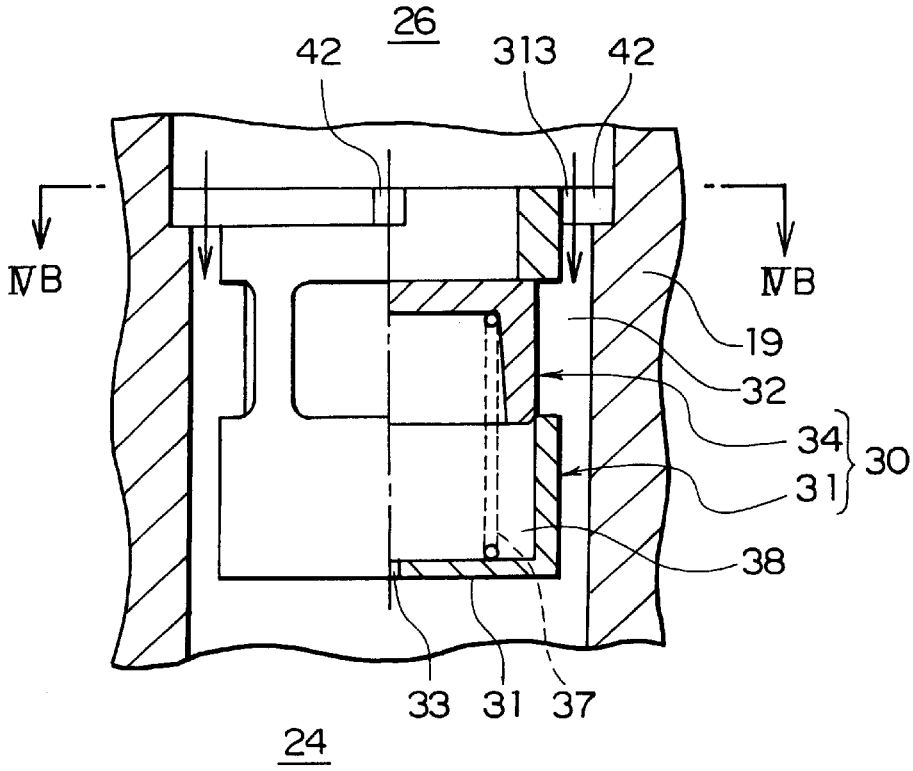
FIG. 4A is a sectional view of a modification of the main portion illustrated in FIGS. 3A and 3B.
Figure 4B:
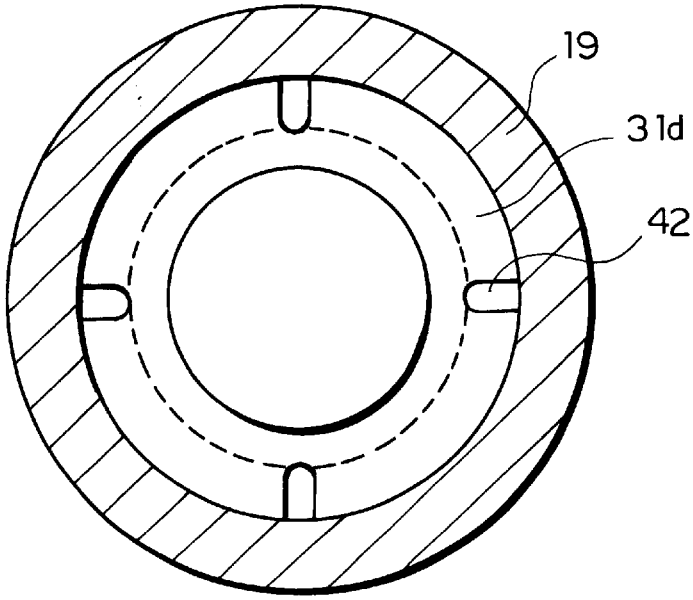
FIG. 4B is a sectional view taken along a line IVB—IVB in FIG. 4A.
Figure 5A:
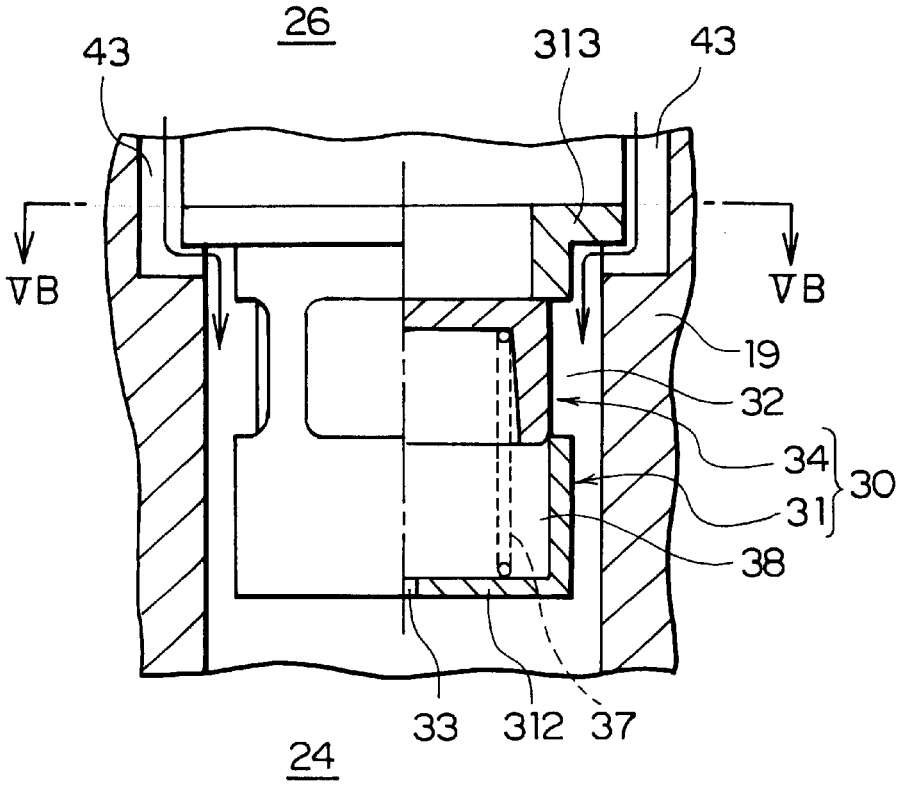
FIG. 5A is a sectional view of another modification of the main portion illustrated in FIGS. 3A and 3B.
Figure 5B:
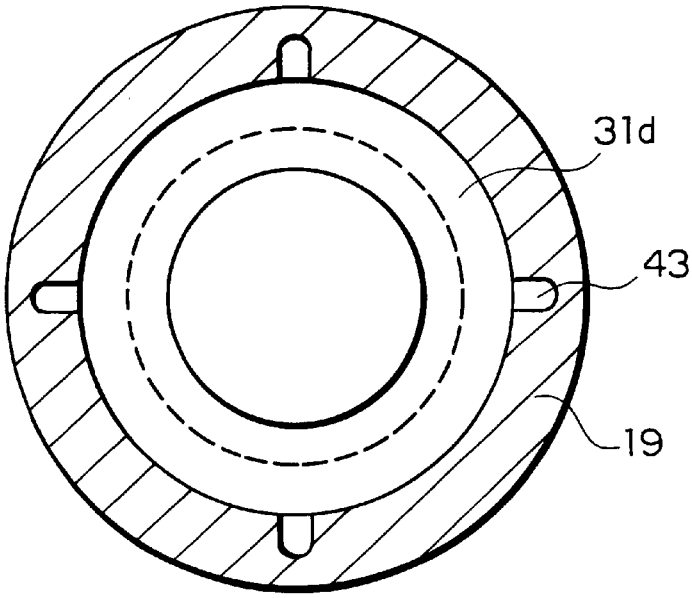
FIG. 5B is a sectional view taken along a line VB—VB in FIG. 5A.

As illustrated in FIGS. 4A and 4B, the flange 31*d* of the opening control valve 30 may be provided with a plurality of bypass holes 42. Alternatively, as illustrated in FIGS. 5A and 5B, the surrounding wall of the suction port 26 may be provided with a plurality of bypass grooves 43. In this event, each of the bypass grooves 43 serves as the bypass channel.

Figure 6A:
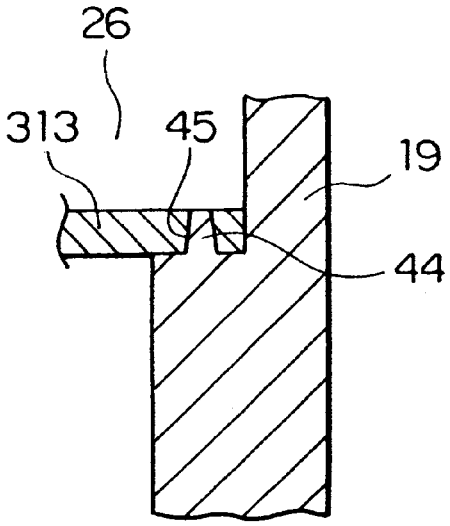
FIGS. 6A through 6D are sectional views for describing various structures of fixing an opening control valve to a cylinder head of the variable displacement compressor.
Figure 6B:
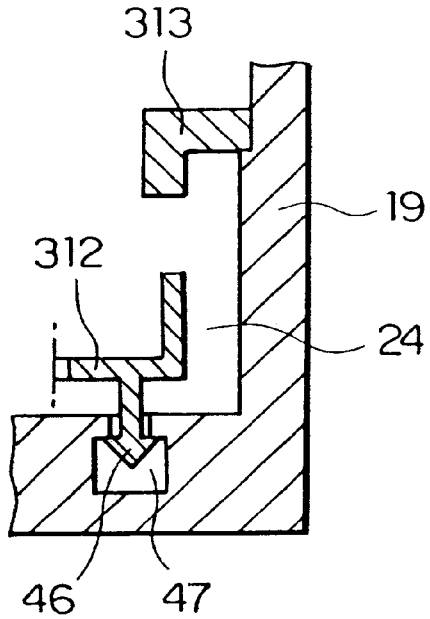
Figure 6C:
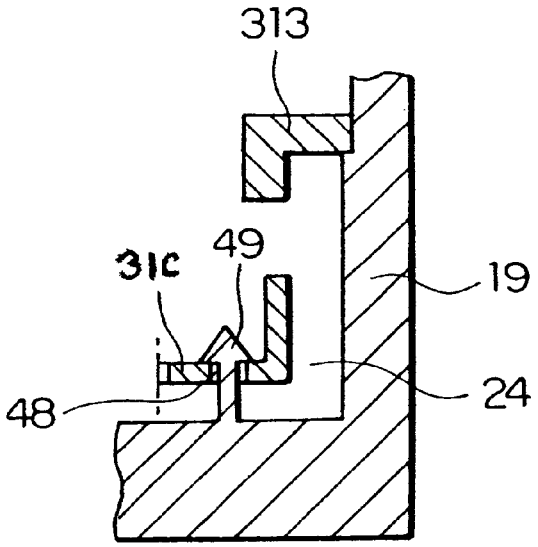
Figure 6D:
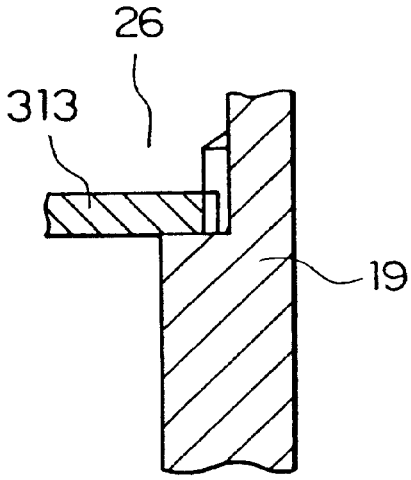

The opening control valve 30 may be fixed to the cylinder head 19 in various other manners different from that described in conjunction with the above-mentioned embodiment. For example, a number of keys are formed in a peripheral edge of the flange 313 in a radial fashion while a number of key grooves are formed in the surrounding wall of the suction port 26 in a radial fashion. Then, the keys are press-fitted into the key grooves. Alternatively, a number of keys are formed in the surrounding wall of the suction port 26 in a radial fashion while a number of key grooves are formed in the peripheral edge of the flange 313 in a radial fashion. Then, the keys are press-fitted into the key grooves. Further alternatively, as illustrated in FIG. 6A, a step portion is formed on the surrounding wall of the suction port 26 and is provided with a protrusion 44. The protrusion 44 is press-fitted into a hole 45 formed in the flange 313. As illustrated in FIG. 6B, the bottom wall 312 is provided with a protrusion 46 to be press-fitted or inserted into a recess 47 formed in the surrounding wall of the suction chamber 24. As illustrated in FIG. 6C, the bottom wall 31*c* is provided with a hole 48 to which a protrusion 49 formed on the surrounding wall of the suction chamber 24 is press-fitted or inserted. As illustrated in FIG. 6D, the flange 313 may be fixed to the surrounding wall of the suction port 26 by screw engagement. In either way, the opening control valve 30 can readily be fixed to the cylinder head 19.

In the variable displacement compressor, the valve body of the opening control valve does not repeatedly perform fine movement so that the pressure pulsation of the refrigerant gas is not caused to occur. As a consequence, the noise resulting from the pressure pulsation of the refrigerant gas is not produced.

What is claimed is:

1. A variable displacement compressor of a piston type, comprising:

a suction port;

a suction chamber;

a main channel communicating said suction port with said suction chamber;

a fluid damper comprising:

a valve case having an opening formed through a bottom wall of said valve case;

a valve body slidably contained within said valve case; and a spring positioned between said valve body and said bottom wall, wherein said fluid damper is adapted to variably control an opening area of said main channel; and a bypass channel formed entirely outside of said valve body to communicate said suction port with said suction chamber.

2. The variable displacement compressor according to claim 1, further comprising a return spring coupled to said valve body for urging said valve body to make said valve body close said main channel.

3. A variable displacement compressor of a piston type, comprising:

a suction port;

a suction chamber;

a main channel communicating said suction port with said suction chamber;

a fluid damper comprising:

a valve case having an opening formed through a bottom wall of said valve case;

a valve body slidably contained within said valve case; and a spring positioned between said valve body and said bottom wall, wherein said fluid damper is adapted to variably control an opening area of said main channel;

a bypass channel formed entirely outside of said valve body to communicate said suction port with said suction chamber; and a compressor housing defining said suction port and said suction chamber, wherein said valve case is fixed to said compressor housing and defines said main channel, and said bypass channel is formed through said valve case.

4. The variable displacement compressor according to claim 3, wherein said compressor housing has a recessed portion at said suction port, said valve case having a protrusion press-fitted into said recessed portion.

5. The variable displacement compressor according to claim 3, wherein said compressor housing has a protrusion at said suction port, said valve case having a recessed portion press-fitted over said protrusion.

6. The variable displacement compressor according to claim 3, wherein said valve case is engaged with said compressor housing by screw engagement.

7. A variable displacement compressor of a piston type, comprising:

a suction port;

a suction chamber;

a main channel communicating said suction port with said suction chamber;

a valve case;

a valve body slidably contained within said valve case for variably controlling an opening area of said main channel; and a bypass channel formed entirely outside of said valve body to communicate said suction port with said suction chamber; and a compressor housing defining said suction port and said suction chamber; wherein said valve case is fixed to said compressor housing and defines said main channel, and said bypass channel is formed between said compressor housing and said valve case.

* * * * *